US008156777B1

(12) United States Patent
Widen

(10) Patent No.: US 8,156,777 B1
(45) Date of Patent: Apr. 17, 2012

(54) LOCK AND KEY WITH DOUBLE CODE PATTERN

(75) Inventor: Bo Widen, Torshalla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 12/889,150

(22) Filed: Sep. 23, 2010

(51) Int. Cl.
*E05B 19/06* (2006.01)
*E05B 27/10* (2006.01)

(52) U.S. Cl. ..... 70/409; 70/392; 70/494

(58) Field of Classification Search ..... 70/337, 70/339, 340, 350, 352, 358, 378, 390, 490–494, 70/405–407, 409
See application file for complete search history.

(56) References Cited

U.S. PATENT DOCUMENTS

| | | | | |
|---|---|---|---|---|
| 3,393,542 | A * | 7/1968 | Crepinsek | 70/358 |
| 3,731,507 | A * | 5/1973 | Wolter | 70/358 |
| 3,824,818 | A * | 7/1974 | Neale | 70/358 |
| 5,819,566 | A * | 10/1998 | Eden, Jr. | 70/358 |
| 6,105,404 | A * | 8/2000 | Field et al. | 70/365 |
| 6,477,876 | B1 * | 11/2002 | Kim | 70/495 |
| 7,159,424 | B2 * | 1/2007 | Widen | 70/409 |
| 7,207,200 | B2 * | 4/2007 | Eden et al. | 70/358 |
| 7,421,869 | B2 * | 9/2008 | Osada | 70/358 |
| 7,487,653 | B2 * | 2/2009 | Widen | 70/409 |
| 7,665,337 | B1 * | 2/2010 | Widen | 70/409 |
| 2009/0272161 | A1 * | 11/2009 | Talamonti | 70/491 |

FOREIGN PATENT DOCUMENTS

AT 392 508 B 4/1991

* cited by examiner

*Primary Examiner* — Suzanne Barrett
*Assistant Examiner* — Christopher Boswell
(74) *Attorney, Agent, or Firm* — Birch, Stewart, Kolasch & Birch, LLP

(57) ABSTRACT

The invention relates to a lock and key combination including a cylinder lock with a rotatable key plug having a key slot for receiving a flat key blade (100) on a key, and at least two side locking tumblers (201*a*, 201*b*; 301, 302; 401, 402) which are guided in associated chambers in the key plug and have transverse fingers (211*a*, 211*b*: 311, 312; 411, 412*a*, 412*b*) projecting into the key slot. There is a code pattern (110) in a side recess (115, 118) of the key blade comprising at least two separate code surfaces formed on at least one side surface (101) of the key, including a primary code surface (131-135; 141'; 151) located in an external portion of the side recess and adjoining said one side surface (101), and a secondary code surface (141-145; 142'152) being defined in a groove forming a deeper portion of the side recess. The primary and secondary code surfaces engage with first and second fingers (211*b*, 311, 411 and 211*a*, 312, 412*a*) on associated side locking tumblers. Master key systems can be designed by using such locks and keys.

30 Claims, 10 Drawing Sheets

LOCK AND KEY WITH DOUBLE CODE PATTERN

FIELD AND BACKGROUND OF THE INVENTION

Figure 1:
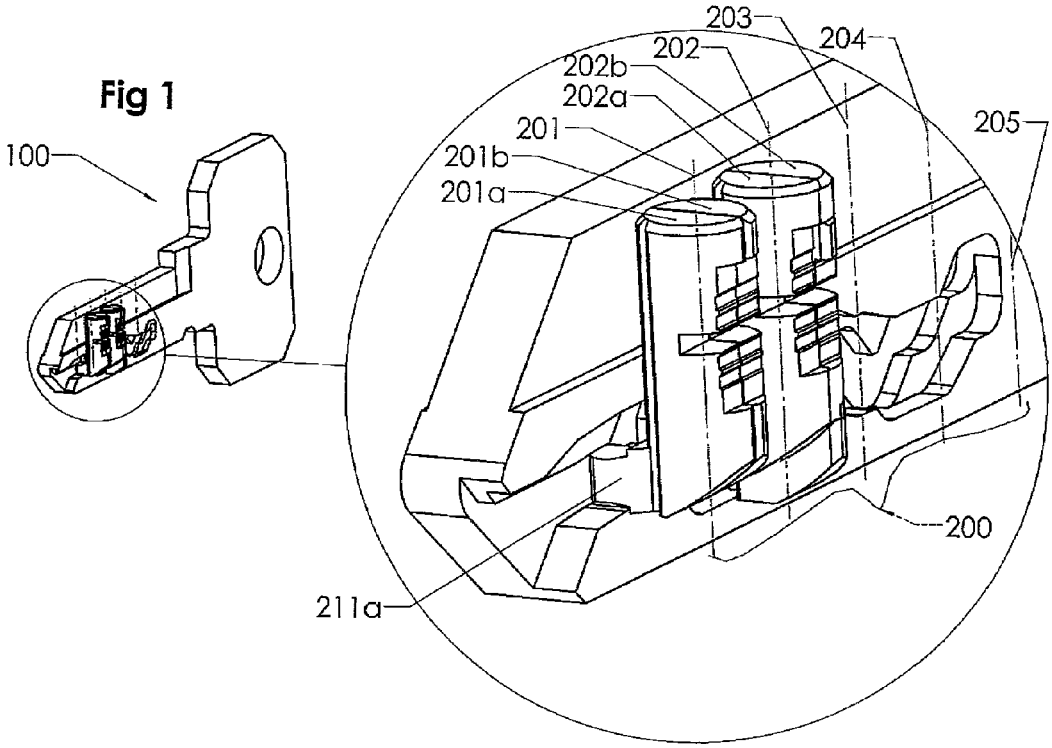

The present invention relates to a lock and key combination including a cylinder lock and a key with a flat key blade. The lock has a rotatable key plug having a key slot for receiving a flat key blade, and at least two side locking tumblers in the cylinder lock, said side locking tumblers being guided for elevational and possibly also rotational movement in associated chambers in said key plug and having transverse fingers projecting into the key slot for engagement with the key blade, upon inserting the key into the key slot. The key blade has an associated code pattern in a side recess for engagement with said side locking tumblers and positioning said side locking tumblers into positions that allow the key plug to rotate in the cylinder lock upon inserting a correctly coded key into the key slot.

Such locks and keys are previously known, e.g. from the U.S. Pat. Nos. 4,756,177 and 5,715,717 (both in the name of Bo Widén). These known lock and key systems provide a high level of security and offer a large number of code combinations.

OBJECT OF THE INVENTION

Against this background, the present invention aims at providing an even higher number of code combinations while retaining at least the same or an improved security level.

SUMMARY OF THE INVENTION

This object is achieved for a lock and key combination where the associated code pattern in the side recess of the key blade comprises at least two separate code surfaces formed on at least one side of the key blade and extending along at least a part of the length of the key blade, comprising, on the same side of the key blade:

- a primary code surface located on at least one side wall or shelf surface in an external portion of said side recess and adjoining said one side surface, and
- at least one secondary code surface being defined in an internal, deeper portion of said side recess, and wherein said side locking tumblers of said cylinder lock comprise:

- at least one first side locking tumbler having a transverse first finger configured to engage with said primary code surface on said side wall or shelf surface in said recess, and
- at least one second side locking tumbler, located on the same side of the key slot as said first side locking tumbler and having a transverse second finger, extending into the internal, deeper portion of said side recess and being configured to engage with said secondary code surface.

Thus, the two kinds of side locking tumblers, provided with first and second fingers, respectively, will provide extensive code combinations in conjunction with the various code locations on the two code surfaces. These code surfaces may extend in parallel to each other, forming a very compact overall code configuration in the lock as well as on the key blade.

In a feasible embodiment, at least one of the code surfaces is wave-like.

The primary code surface may be defined by one of two opposite first side walls in a groove in the external portion of the side recess, said groove also having an inside wall. Likewise, the secondary code surface may be defined by a groove having opposite second side walls and a bottom wall therebetween. In this way, the two code surfaces can be formed separately and still be confined in a very limited area at the side of the key blade. Even so, the number of possible code combinations is very great.

As will be apparent from the description below, the configuration of the code pattern may be modified in many ways. Such features are also stated in the dependent claims.

Advantageously, the code pattern may be used for establishing a master key system including one or more master keys, and a number of specific keys which operate only one lock or a relatively small number of locks.

The invention will now be explained in more detail, with reference to the appended drawings which show some examples of possible embodiments.

SHORT DESCRIPTION OF THE DRAWINGS

Figure 1A:
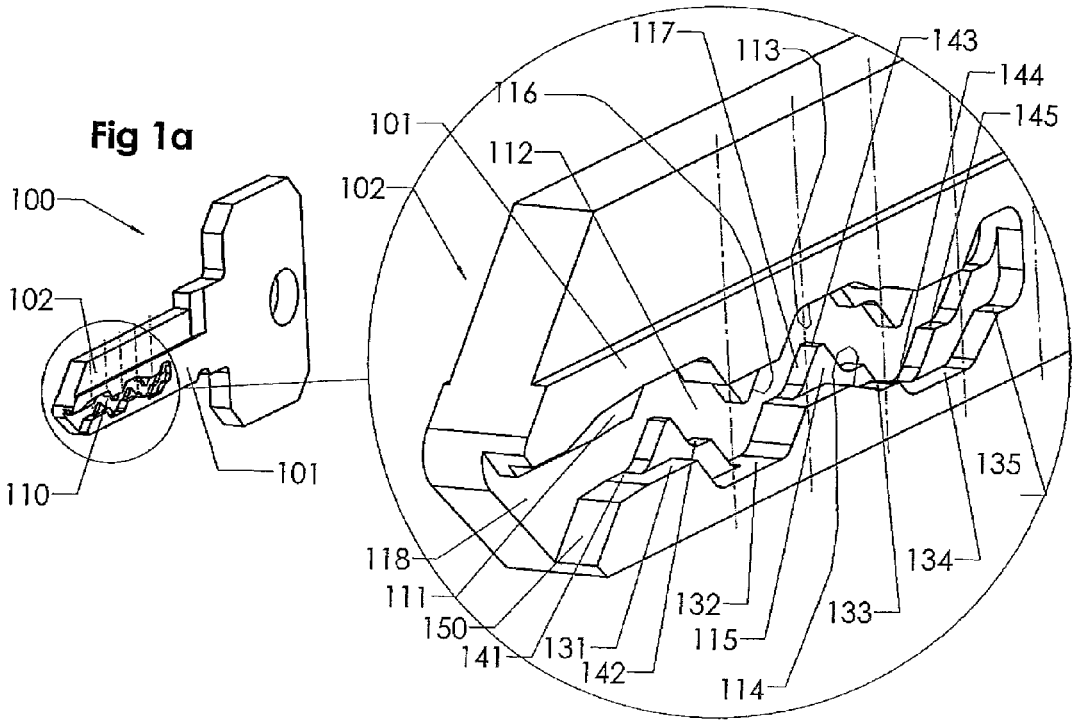
Figure 2:
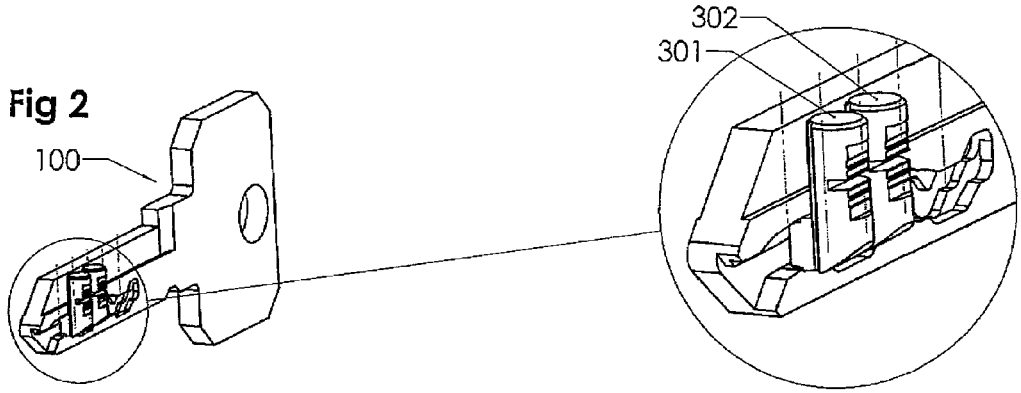
Figure 2A:
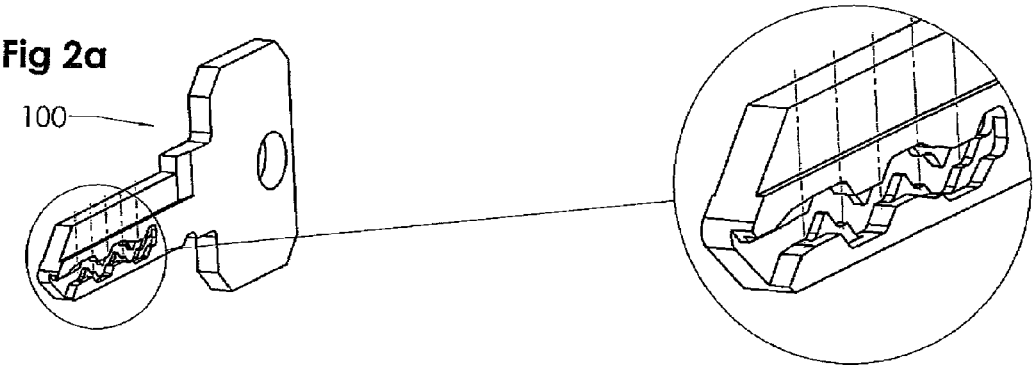
Figure 2B:
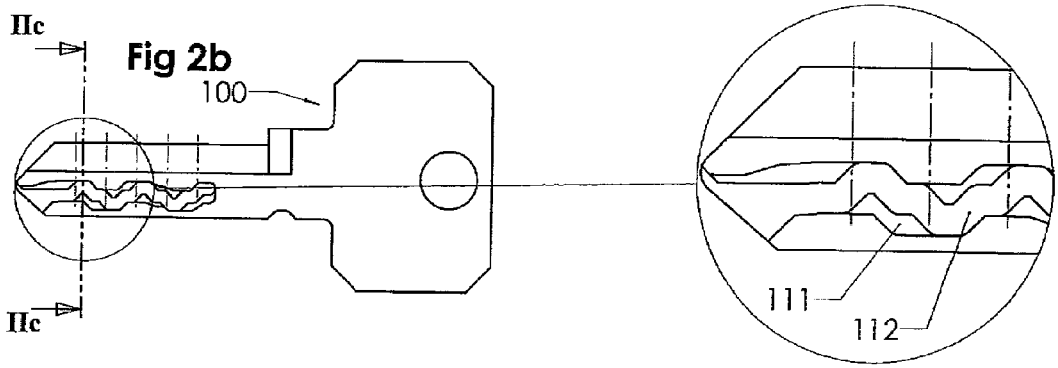
Figure 2C:
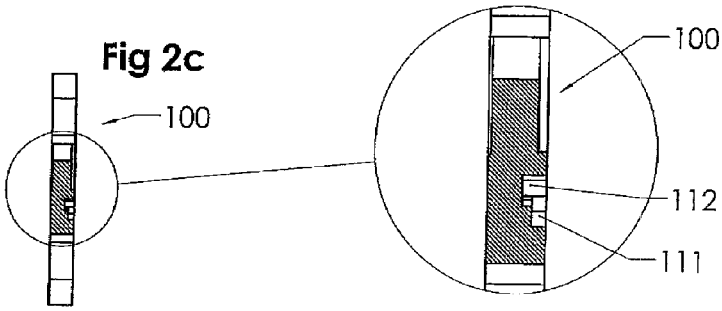
Figure 3:
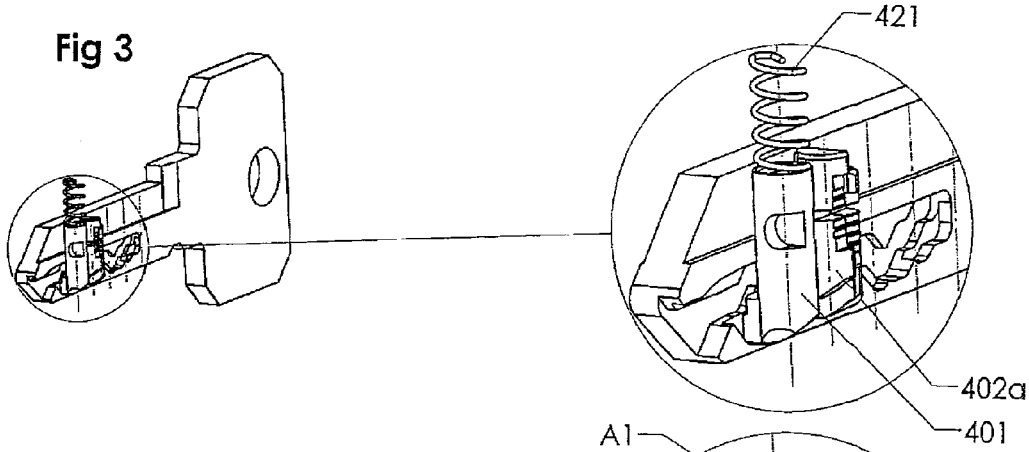
Figure 3A:
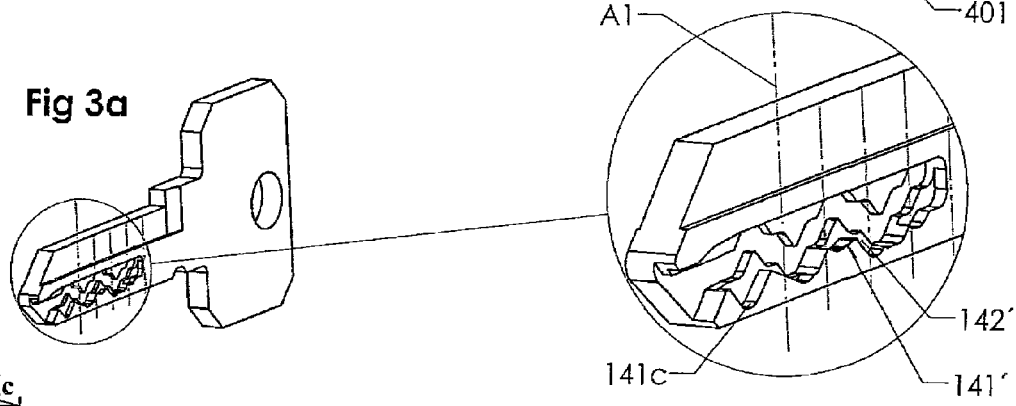
Figure 3B:
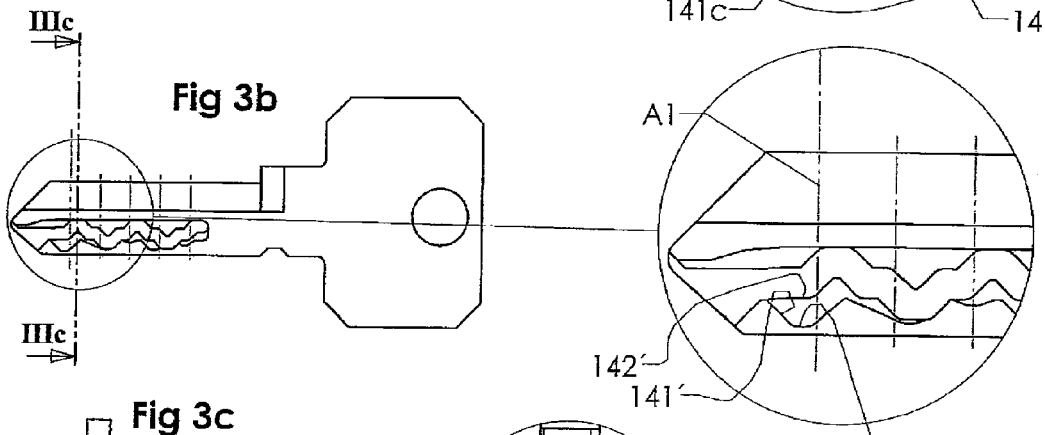
Figure 3C:
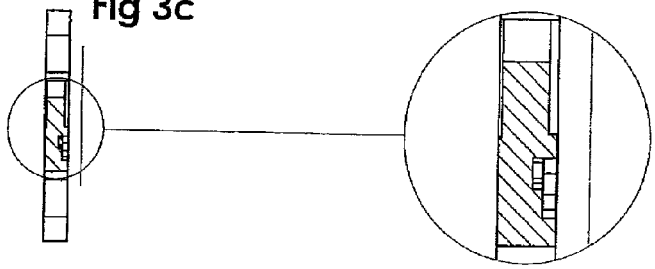

FIG. 1 shows in a perspective view a key having a double code pattern on the key blade, and a number of side locking tumblers of an associated lock (the rest of the lock is not shown on the drawings), each side locking tumbler consisting of a half-cylindrical body;

FIG. 1*a* shows the key without any side tumblers, thereby showing the double code pattern better than in FIG. 1;

FIG. 2 shows, likewise in a perspective view, a second embodiment with side locking tumblers, each tumbler being formed by a single cylindrical body;

FIG. 2*a* shows the key, without any side locking tumblers;

FIG. 2*b* shows the key of FIG. 2 in a side view;

FIG. 2*c* shows a section of the key in FIG. 2*b*, along the line IIc-IIc;

FIG. 3 shows, also in a perspective view, a key with a number of side locking tumblers of a third embodiment, there being different kinds of side locking tumblers;

FIG. 3*a* shows the key of FIG. 3, without any side locking tumblers;

FIG. 3*b* shows the key of FIG. 3 in a side view;

FIG. 3*c* shows a section of the key in FIG. 3*b*, along the line IIIc-IIIc.

Figure 4A:
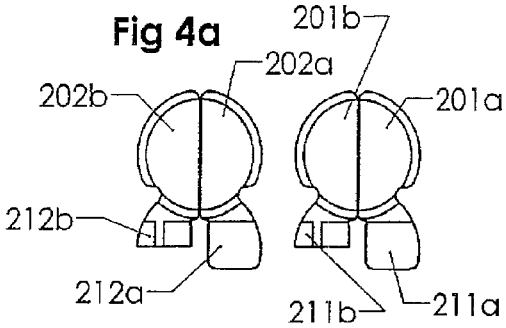
Figure 4B:
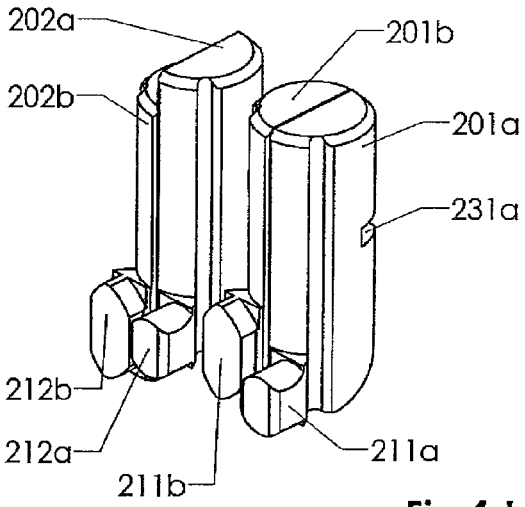
Figure 4C:
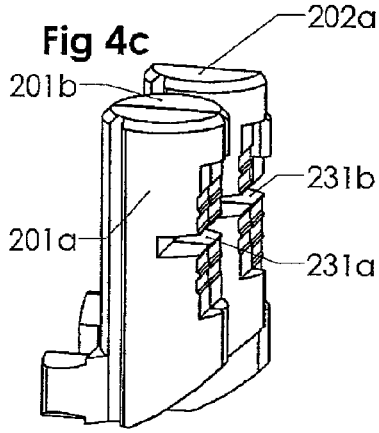
Figure 4D:
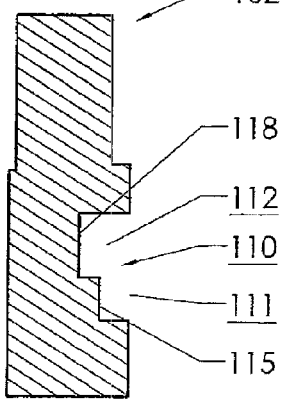

FIGS. 4*a*, 4*b*, and 4*c* show, in a top view, a perspective view and a different perspective view, respectively, two pairs of half cylindrical side locking tumblers, each having a projecting finger;

FIG. 4*d* shows a section of an associated key;

FIGS. 5*a*, 5*b*, 5*c*, and 5*d* show two cylindrical side locking tumblers with different projecting fingers, and a corresponding section of an associated key;

FIGS. 6*a*, 6*b*, 6*c*, and 6*d* show two different kinds of side locking tumblers with various projecting fingers, and a corresponding section through an associated key;

FIGS. 7*a*, 7*b*, 7*c*, and 7*d*, 7*e*, 7*f* show cylindrical side locking tumblers with various projecting fingers;

FIGS. 8*a*, 8*b*, 8*c*, and 8*d*, 8*e*, 8*f* show a cylindrical side locking tumbler having projecting fingers with a widened outer portion, a tumbler with a narrow finger, and a cross-section and a side view of the associated key, respectively;

FIGS. 9*a*, 9*b*, 9*c* and 9*d*, 9*e*, 9*f* show similar views of side locking tumblers having projecting fingers with a downwardly directed outer portion; and FIG. 10 illustrates schematically a master key system.

DETAILED DESCRIPTION OF PREFERRED EMBODIMENTS

In FIGS. 1 and 1*a* there is shown a combination of a key 100 and a number of side locking tumblers 201*a*, 201*b*, 202*a*,

202*b* of an associated lock 200 (not shown in its entirety), two of the side locking tumblers 201*a*, 201*b*, 202*a*, 202*b* (four halves) being fully drawn, and three of them 203, 204, 205 being schematically indicated by dash-dotted lines. The side locking tumblers in this embodiment are each split into two halves 201*a*, 201*b*, etc which are independently movable elevationally (up and down) in a common chamber or cavity in a key plug of the lock 200. The key plug, having a central key slot for receiving the key 100, is not shown on the drawings but may be formed in a way known previously, except for the side locking tumblers which are novel, as will be explained below.

The key 100 is provided with a new kind of code pattern (see FIG. 1*a*), viz. a double code pattern 110 comprising two separate code surfaces: a primary code surface formed by a relatively shallow, external recess portion or groove 111 (or rather a side surface 114 thereof) in a side recess on a side surface 101 of the flat key blade 102, and a secondary code surface formed in a deeper, internal groove 112. The external groove, forming the primary code surface, is defined by two opposite side walls 113, 114 and a (broken) inside or bottom wall 115 therebetween. The lower side wall 114 forms a coded longitudinal surface which in this case is wave-like. At certain positions, this wave-like coded surface has code portions corresponding to the positions of the various side locking tumblers 201 (namely the right half 201*b* in FIG. 1), 202 (namely the right half 202*b* in FIG. 1), 203, 204 and 205. These code portions are denoted 131, 132, 133, 134, 135 in FIG. 1*a*. They will support the side locking tumbler halves 201*b*, 202*b*, 203*b*, etc. in well-defined elevational (or vertical) positions when the key has been properly inserted into the lock 200.

It should be noted that it is sufficient to have just the coded lower surface or side wall 114, whereas the upper side wall 113 is not necessary for coding. However, the upper side wall 113 may be used to positively guide the transversely projecting first finger of the first side locking tumbler up and down so that it will always engage with the lower side wall 114. On the other hand, if this upper side wall 113 is left out, the first side locking tumblers should be brought in contact (with its first finger, as will be explained below) with the side wall 114 by means of e.g. a spring or the like, compare FIGS. 3, 6*a*, 6*b* and 6*c* showing a helical spring. Thus, the lower side wall 114 can be cut out adjacent to (and underneath) a shelf surface on the side of the key blade 102. Then, preferably, the depth or thickness of the shelf may be the same as the depth of the lower side wall 114. In this way, there will be no side wall located opposite to the side wall 114.

In this embodiment, there is an adjoining inside or bottom wall 115 which is substantially parallel to the external side surface 101 of the key blade 102. This inside or bottom wall 115 extends between the opposite side walls 113, 114 of the external groove 111. The width of this external groove is greater (in this embodiment) than the deeper, internal groove 112 which is cut into the inside or bottom wall 115.

The internal, relatively deep groove 112 also has opposite side walls, namely an upper side wall 116 and a lower side wall 117. Between these side walls 116, 117, the groove has a bottom wall 118, which is also substantially parallel to the external side surface 101 of the key 100 (and also to the bottom wall 115 or the external groove 111).

The two grooves 111, 112 will operate independently of each other and guide the respective side locking tumblers by way of their first and second fingers, respectively. This will be better understood from FIGS. 4*a*, 4*b* and 4*c* which show the side locking tumblers 201*a*, 201*b* and 202*a*, 202*b* which are also shown in FIG. 1*a*. Thus, the half cylindrical side locking tumbler 201*a* has a relatively long or second finger 211*a*, which engages and follows the wave-like code surface or side wall 117, when the key is being inserted into the lock. The two half-cylindrical side locking tumblers 201*a*, 201*b* are non-rotationally guided in their associated chambers in the key plug (not shown). Therefore, the tumblers 201*a*, 201*b* will not rotate, and the transversely projecting first and second fingers 211*a*, 211*b* will not pivot when the side locking tumblers move up and down.

In this embodiment, both of the fingers 211*a*, 211*b* are positively guided in the associated groove 111 and 112, respectively, when the key is moved longitudinally. For this purpose, the long finger 211*a* is rather narrow at its free end portion, corresponding to the width or height of the internal, rather narrow groove 112, whereas the short finger 211*b* is relatively wide or high, so that it fills out the full height or width of the external, relatively wide groove 111.

Although the two grooves 111, 112 are independently configurated, there is a certain condition that has to be observed: the internal groove 112 should normally not cross the external groove 111 (but may do so in certain situations), because then the external groove 111 will be interrupted and may disturb the movement of the short finger 211*b* and the associated side locking tumbler 201*b*.

When a correctly configurated key 100 has been fully inserted into the lock 200, the side locking tumblers 201*b*, 202*b*, 203*b*, etc. will be located in well-defined positions determined by the code surface portions 131, 132, 133, 134, 135 of the side wall 114, and the adjacent side locking tumblers 201*a*, 202*a*, 203*a* will likewise be located in well-defined positions determined by the code surface portions 141, 142, 143, 144, 145 of the lower side wall 117 of the internal groove 112. In these well-defined positions, the side locking tumblers 201*a*, 201*b*, . . . ,205 will have their back side recesses 231*a*, 231*b* lined up so as to receive a side bar (not shown) which will permit rotation of the key plug (not shown) within the cylinder lock 200, as is well known per se in the art.

FIG. 4*d* shows a cross-section through the key blade 102 with its double code pattern 110, including a wide or high, but shallow external groove 111 and a narrow, rather deep internal groove 112, and the bottom surfaces 115, 118 of these grooves. In this embodiment, the deepest groove 112 has a depth which is less than half the thickness of the key blade 102.

As is also well known in the art, the wave-like code patterns formed by the grooves 111, 112 have a ramp surface (in this case a common ramp surface) 150 at the free end or tip of the key blade 102. Accordingly, when the key 100 is inserted into the key slot of the lock, the side locking tumblers of the lock 200 (no details of the lock are shown) will climb with their fingers onto the ramp 150 and will then follow the respective wave-like groove 111, 112 while engaging with the upper and lower surfaces of the finger against the opposite side walls 116, 117 and 113, 114, respectively. In doing so, the side locking tumblers 201*a*, 201*b*, 202*a*, 202*b* will move upwards and downwards until the key blade 102 is fully inserted and the respective fingers 211*a*, 211*b*, 212*a*, 212*b* etc. bear on the surface portions 131, 132, 133, 134, 135 and 141, 142, 143, 144, 145, respectively, which form codes and ensure that the recesses 231*a*, 231*b*, etc align and permit the side bar (not shown) to enter into these recesses and enable the key plug to rotate in the cylindrical housing (not shown) of the lock 200.

It will be understood that the vertical positions of the various side locking tumblers having different fingers (long and short fingers, or first and second fingers) will be generally different and independent from each other. In this way, a very great number of possible codes can be provided in spite of the fact that the double code 110 (111, 112) is very compact and confined to a limited region of the key blade. Nevertheless, the side locking tumblers can be movably mounted in standard type cylindrical chambers in the key plug.

As an alternative to a sidebar cooperating with recesses at the back of each tumbler, and as is well-known in the art, the tumblers may be extended in their longitudinal directions (up or down) so as to cooperate with corresponding bores in the key plug, adjacent to the cylindrical inner surface of the housing of the lock.

An important aspect of the present invention is that there are two code surfaces, located adjacent to each other, in the key blade. The side locking tumblers, on the other hand, do not have to be of the longitudinally split type, as is shown in FIGS. 1, 4*a*, 4*b*, 4*c*. Rather, all or some of them may be of some other type, as long as some (or at least one of them) have short or first fingers and others (or at least one of them) have long or second fingers.

An embodiment with cylindrical, massive side locking tumblers is shown in FIG. 2 (and the associated key in FIGS. 2*a*, 2*b*, 2*c*). Each such cylindrical side locking tumbler 301, 302, etc. (see also FIGS. 5*a*, 5*b* and 5*c*) is provided with a transverse finger 311, 312, etc., some of these fingers (311 in FIG. 5*a*) being short and high, i.e. a "first" finger, and others (312 in FIG. 5*a*) being long and narrow, i.e. a "second" finger. Like in the previous embodiment the first finger 311 engages with a code surface in an external portion 111 of the side recess of the key blade 102, whereas the long and narrow "second" finger engages and follows the deeper groove 112 (in FIG. 4*d*, the deeper groove 112 happens to be located very high and, in FIG. 5*d*, the deeper groove 112 happens to be located lower down).

Figure 5A:
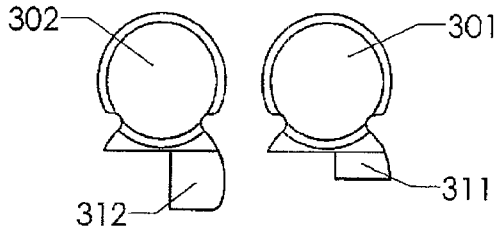
Figure 5B:
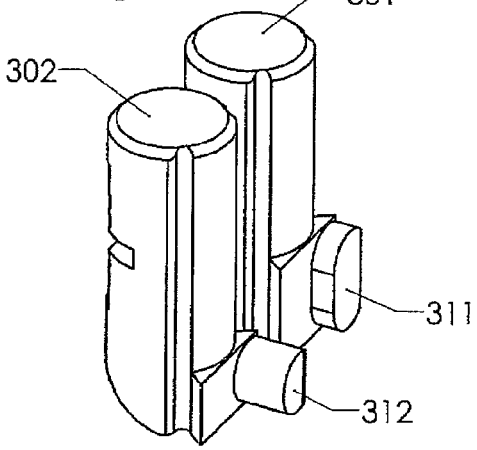
Figure 5C:
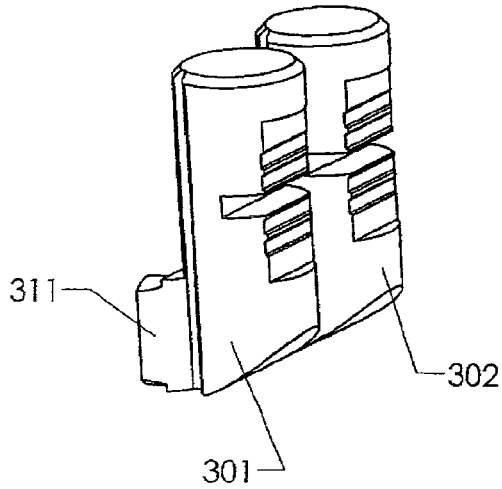
Figure 5D:
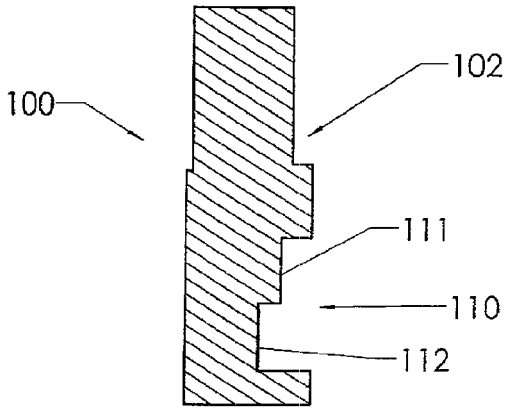
Figure 7A:
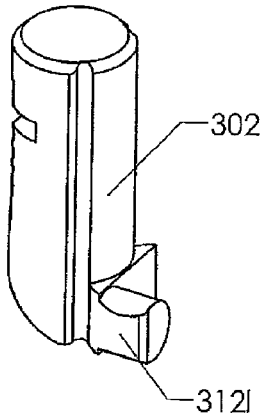
Figure 7B:
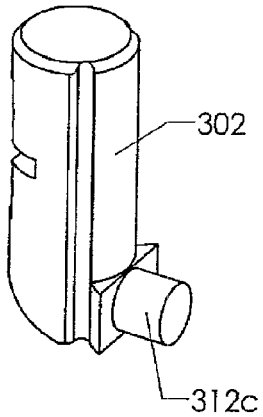
Figure 7C:
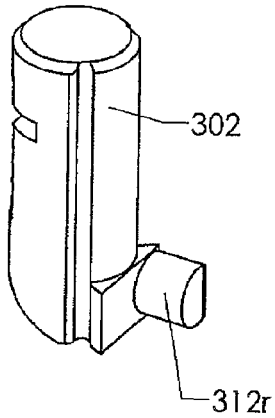
Figure 7D:
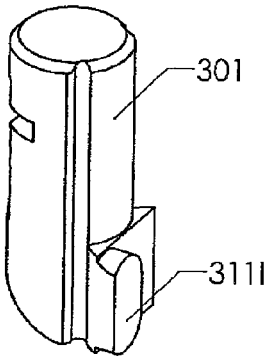
Figure 7E:
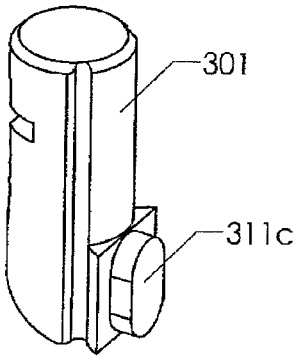
Figure 7F:
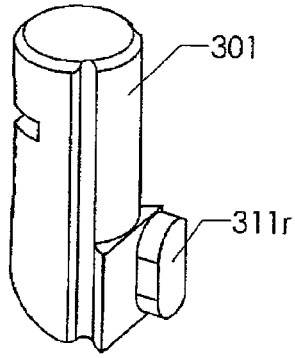

In FIGS. 5*a* and 5*b*, the fingers 312, 311 are shown to be displaced to the right relative to the body portion of the side locking tumbler. However, of course, these fingers might as well be located centrally or to the left. Such different displacements are illustrated in FIGS. 7*a*, 7*b*, 7*c* (for a long and narrow or "second" finger 312*l*, 312*c*, 312*r*) and in FIGS. 7*d*, 7*e*, 7*f* (for a short and high or "first" finger 311*l*, 311*c*, 311*r*).

There are also other possibilities to mix different kinds of side locking tumblers. In FIG. 3 (and FIGS. 6*a*, 6*b*, 6*c*), there is shown a first locking tumbler 401, being biased by a helical spring 421 causing the transverse finger 411 to stay in contact with the external, wave-like code surface 141', and a pair of second locking tumblers 402*a*, 402*b*, being of the kind shown in FIG. 4*a* (both with long and narrow fingers 412*a*, 412*b*) and being guided by the wave-like deeper groove 142' (see FIG. 6*d*). So, these first and second locking tumblers 401 and 402*a*, 402*b* will contact and follow the respective, differently configurated code surfaces 141' and 142', respectively.

Figure 6A:
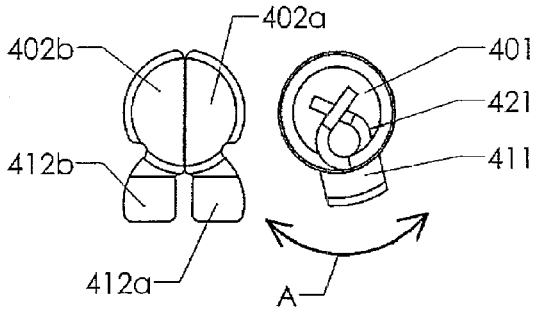
Figure 6B:
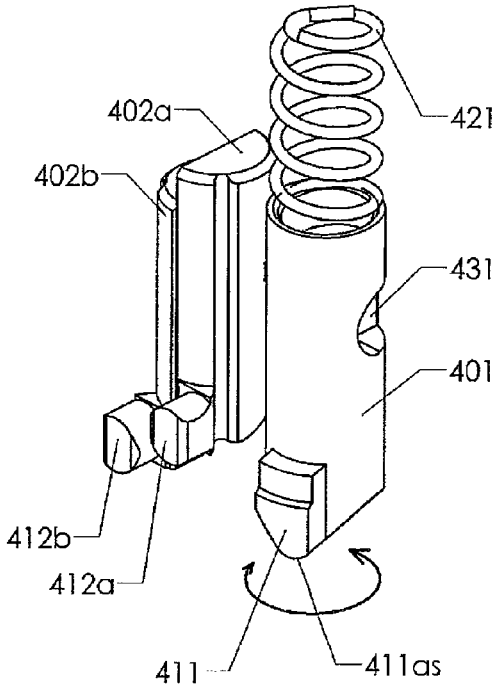
Figure 6C:
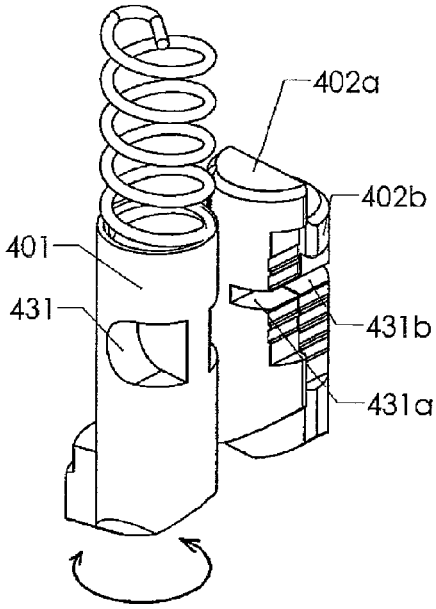
Figure 6D:
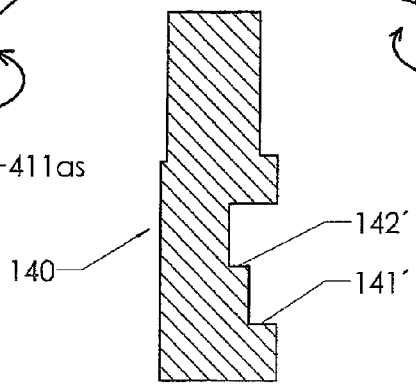

The first side locking tumbler 401 is of the kind disclosed in the international patent application WO 2006/098675, i.e. it is rotatable between two rotary end positions, as indicated by the arrow A in FIG. 6*a*, and the finger 411 is asymmetrically formed, as appears from FIG. 6*b*, with a key contacting surface 411*as* which is displaced in the circumferential direction in relation to a central plane through the tumbler 401 and the finger 411. In this way, the finger can be positioned by the associated code portion 141*c* (FIGS. 3*a* and 3*b*), with the key contacting surface 411 as being seated in a well-defined position in the code portion which is formed as a concavity, as disclosed in said WO publication. When the key blade is seated in the lock, the concavity is generally displaced to the right or to the left or located centrally in relation to the position (A1 in FIGS. 3*a* and 3*b*) of the side locking tumbler 401, thereby forming a code. Accordingly, the first side locking tumbler 401 will be positioned elevationally (up and down) as well as rotationally. In a correct position, a recess 431 on the back will be aligned with corresponding, aligned recesses on the back of the pair of side locking tumbler halves 402*a*, 402*b*, thereby permitting a sidebar (not shown) to be seated into the aligned recesses, so that the key plug (not shown) can be rotated.

In the embodiments described so far, the external part of the recess has been rather wide, and the internal, deeper part (forming a groove) has been rather narrow. In the two embodiments to be described below, the configuration is the other way round: the external part of the recess is relatively narrow, and the internal, deeper part is relatively wide.

Figure 8A:
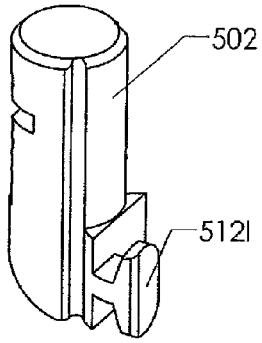
Figure 8B:
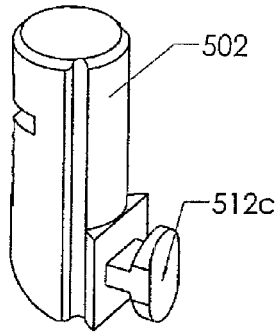
Figure 8C:
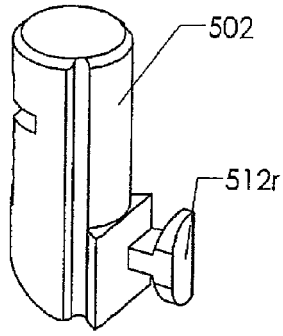

In FIGS. 8*a*, 8*b*, 8*c* there are shown three different "second" side locking tumblers 502 having relatively long fingers 512*l*, 512*c*, 512*r* being positioned to the left, centrally and to the right, respectively. Anyone of these second tumblers will fit into a side recess of an associated key 150 (FIG. 8*e*) having an undercut, deep groove 152. The groove is undercut at the top and the bottom, so as to accommodate any one of the fingers 512*l*, 512*c*, 512*r* with its widened outermost portion.

Figure 8D:
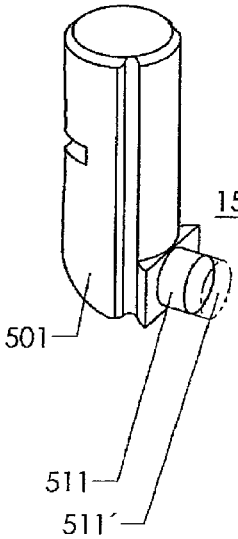
Figure 8E:
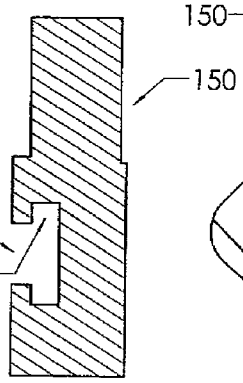
Figure 8F:
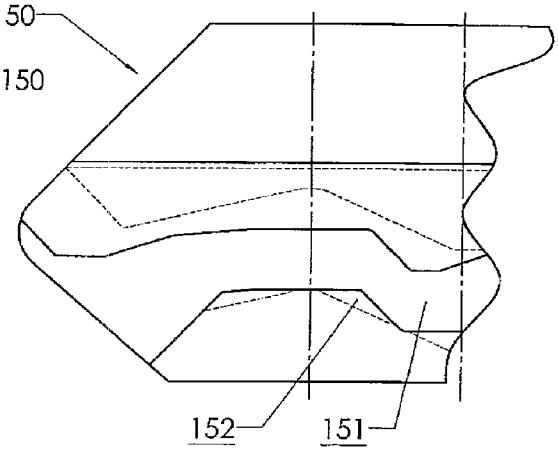

The side recess of the key 150 also has a narrower external portion, which is dimensioned to snugly receive and guide the narrow finger 511 of a "first" side locking tumbler 501 (FIG. 8*d*). In this case, it is not strictly necessary that the narrow finger 511 is shorter than the fingers 512*l*, 512*c*, 512*r*. It may have the same length as indicated by the dotted contour 511'. Although this modified narrow finger 511' is relatively long, the free end portion will not contact any coded surface. The fingers 512*l*, 512*c*, 512*r* will be guided by the deeper, undercut groove 152, and the narrow finger 511 (or 511') will be guided by the external portion 151 of the side recess.

Figure 9A:
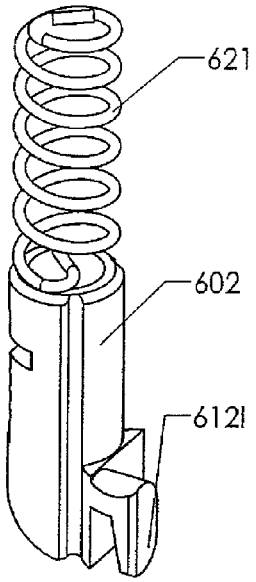
Figure 9B:
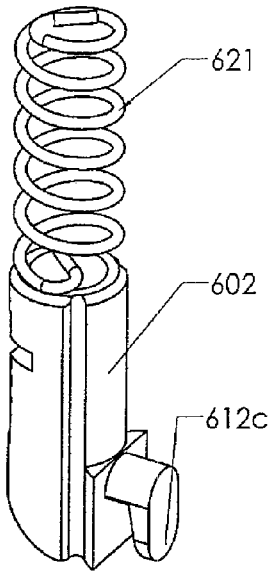
Figure 9C:
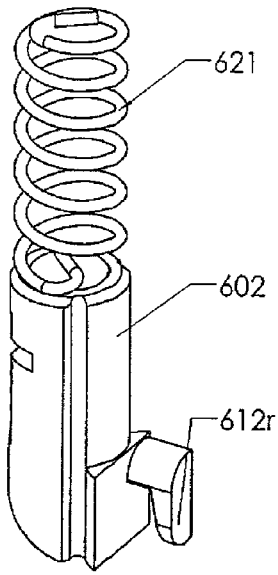
Figure 9D:
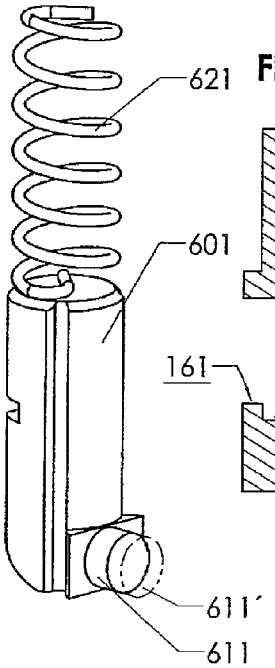
Figure 9E:
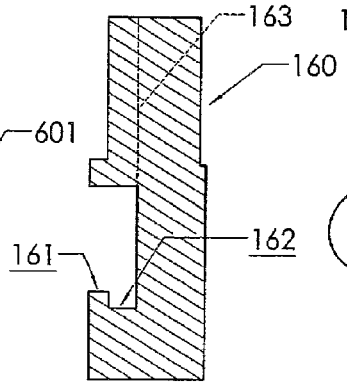

In the embodiment shown in FIG. 9*e*, the key 160 has a side recess or groove with a narrow, external portion 161 and a wider, internal portion 162, which is undercut at its lower part. The side locking tumblers 602 have corresponding relatively long fingers 612*l*, 612*c*, 612*r* provided with a wider outer portion which is directed downwards so as to fit within the undercut groove 162. The inner portions of these fingers are narrower than the external portion 161 of the side recess, so that only the outermost portion is guided by the lower part of the undercut groove 162. This lower part forms a wave-like secondary code surface engaging with the long or "second" finger 612*l*, 612*c* or 612*r* of the second side locking tumblers 602.

A "first" side locking tumbler 601 with a narrow first finger 611 is shown in FIG. 9*d*. The finger 611 may be somewhat longer, indicated by 611', just like the narrow finger in the previous embodiment (FIG. 8*d*). The key 160 itself is also shown in a side view in FIG. 9*f*. Of course, the code surfaces formed by the external and internal portions 161, 162 are generally different in their wave-like configurations, although they have to stay relatively close together because of the geometrical constraints which follow implicitly by the structure of the side recess 161, 162. In this embodiment, the side locking tumblers are held down by upper springs 621, so that their fingers 612*l*, 612*c*, 612*r* will always contact the respective code surface (the lower side surfaces of the external and internal portions 161, 162 of the side recess).

Figure 9F:
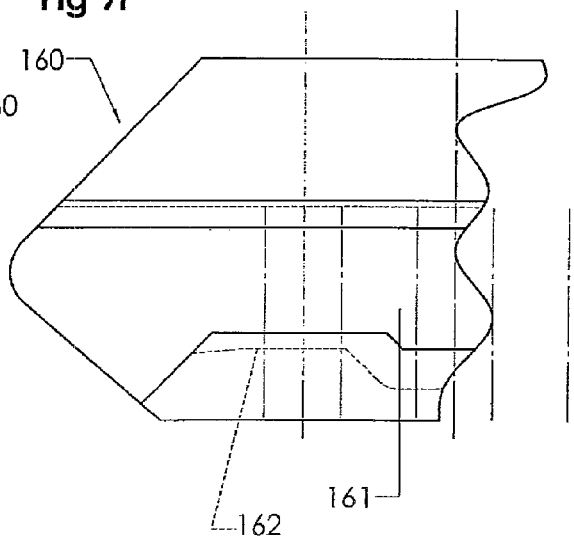

The upper parts of the external and internal grooves 161, 162 do not engage with the side locking tumblers 601, 602, so the upper sidewalls of these grooves may just as well be straight, as shown in FIG. 9*f*.

Moreover it is also possible to remove the upper, left hand part of the key 160, to the left of the dotted line 163, leaving just a shelf surface 161 (forming the first code surface) and the adjoining, internal portion 162 (forming the second code surface).

According to the invention, there should be "first" and "second" side locking tumblers which cooperate with an external and an internal portion (with primary and secondary code surfaces) of a side recess on one side of the key blade. These first and second side locking tumblers may generally be all of the same kind (massive, cylindrical, or half cylindrical, or some other kind) or of different kinds (cylindrical and half cylindrical). Also, the tumbler fingers may be of the same kind for all "first" and all "second" side locking tumblers, or they may be mixed (as illustrated e.g. in FIG. 6*a*).

The code surfaces in the external and inner portions do not have to be "wave-like" but may have other configurations as long as they permit the first and second fingers to slide along these surfaces. They may have rectilinear portions and also small irregularities or steps. Moreover, such irregularities or steps must be small enough to permit the associated finger to climb or step down in the longitudinal direction. There may even be interruptions if the next code surface segment is provided with a ramp or the like which will catch the finger and make it climb on such a ramp.

Of course, a key blade may have double codes on one side only, or on both sides.

A key may also have a conventional code at an upper edge of the key blade, cooperating with centrally located pins.

The key may also be reversible (capable of being turned upside down) and it may also be provided with suitable longitudinal profile grooves.

The number of side locking tumblers may be chosen at will, e.g. only two half cylindrical tumblers. Likewise, the geometrical shape of the tumblers may be different, e.g. with a rectangular cross-section rather than a circular cross-section.

Figure 10A:
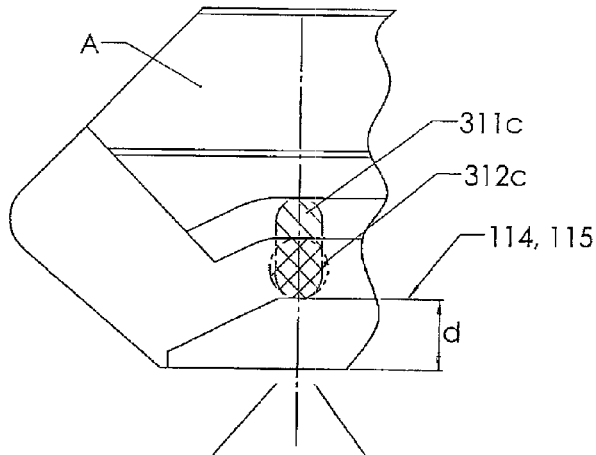
Figure 10B:
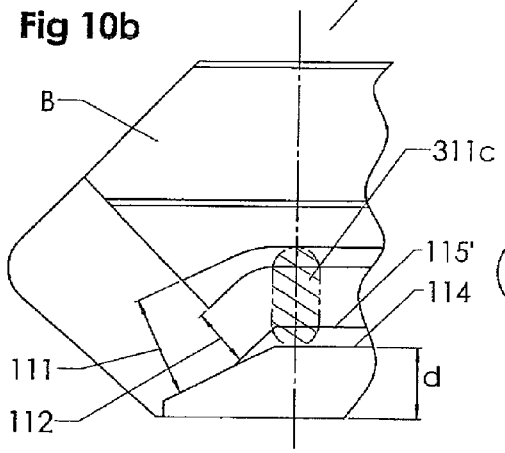
Figure 10C:
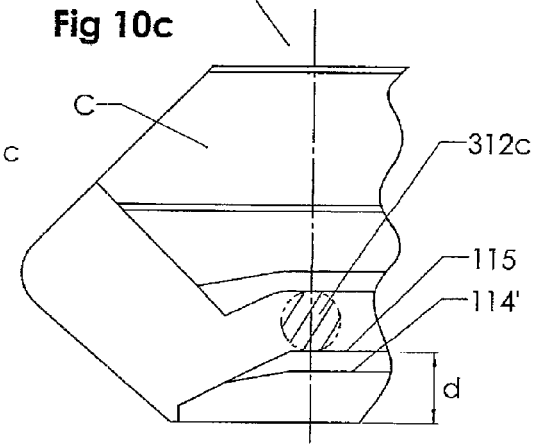

As illustrated in FIGS. 10*a*, 10*b*, 10*c*, the double code pattern may be used to establish a lock and key system with specifically configured keys (B and C in FIGS. 10*b* and 10*c*, respectively) and one or more master keys (FIG. 10*a*). These drawing figures only show the tumbler position and corresponding key code portion located closest to the tip of the key. The same principles, however, apply to the remaining code portions of the key.

The specific key ("change key") B shown in FIG. 10*b* (compare also FIG. 1*a* and FIG. 7*b*, 7*e*) is configured so that a wide or high first groove 111, having a primary code surface 114, accommodates corresponding high (and short) first tumbler fingers 311*c*, being located in a releasing elevation at this position, whereas a narrow, deep second groove 112, having a secondary code surface 115', will not release locks with second tumbler fingers 312*c* being positioned as shown in FIG. 10*c*, because the secondary code surface 115' is too high (higher than "d") at this position (over-lifting).

The specific key C shown in FIG. 10*c*, on the other hand, will operate locks having long tumbler fingers 312*c* located at this particular elevation but not locks having short and high tumbler fingers 311*c*, located as shown in FIG. 10*b*, because the primary code surface 114' is too low at this position (under-lifting). Accordingly, the two specific keys C and B will each operate a specific lock but not both of these locks.

The master key A, however, will operated both locks, as represented by the tumbler fingers 311*c* and 312*c*, because the two code surfaces 114 and 115 are located at the correct levels, in this case at the same level. So, this master key A will operate locks having high, short tumbler fingers 311*c* at releasing positions engaging with the primary code surface 114 as well as locks having narrow, long tumbler fingers 312*c* at releasing positions engaging with the secondary code surface 115. Generally, the master key will be configured to release all locks having different kinds of locking tumblers at various positions, whereas each of the specific keys is configured to release only one or a subset of locks within said group of locks.

By using various principles for master key systems, those skilled in the art will be able to design many different master key systems, which involve the double code pattern of the present invention, including systems with two, three or more levels of master keys. It is also possible to vary the longitudinal position of the respective finger, such as those included in the various embodiments described above.

The invention claimed is:

1. A lock and key combination including;

a cylinder lock with a rotatable key plug having a key slot for receiving a flat key blade, and a key (100) with said flat key blade, and at least two side locking tumblers (201*a*, 201*b*; 301, 302; 401, 402) in said cylinder lock, said side locking tumblers being guided for at least one of elevational and rotational movement in associated chambers in said key plug and having transverse fingers (211*a*, 211*b*; 311, 312; 411, 412*a*, 412*b*) projecting into said key slot for engagement with said key blade, upon inserting said key into said key slot, and an associated code pattern (110) in a side recess (115, 118) of said key blade for engagement with said side transverse fingers and positioning said side locking tumblers into positions that allow said key plug to rotate in said cylinder lock upon inserting a correctly coded key into the key slot, said fingers having different lengths, at least one having a first, short finger length projecting transversely from the side locking tumbler and at least one having a second, long finger length projecting transversely from the side locking tumbler, the short fingers engaging with a primary code surface having a number of first code surface portions at an external portion of said side recess of the key blade, and the long fingers engaging with a secondary code surface having a number of second code surface portions at an internal, deeper portion of said side recess of the key blade, wherein said transverse fingers are each located at a specific longitudinal position centered in relation to or longitudinally displaced from a transverse plane extending through a central axis of the associated chamber, and said first and second code surface portions of said key are specifically distributed longitudinally to allow said transverse fingers to be seated on said first and second code surface portions (111, 112; 141, 142; 151, 152) upon inserting the key into the key slot, wherein said first and second code surface portions are located at distinct positions generally variable or separated in three dimensions in said flat key blade, namely:

in a direction upwards and downwards in a vertical plane defining said flat key blade, in a depth direction perpendicular to said vertical plane, and in a longitudinal direction along said key blade, wherein a compact code pattern with an increased number of code combinations is formed on the key blade.

2. The lock and key combination as defined in claim 1, wherein said secondary code surface is formed by an internal groove forming said deeper portion of said side recess.

3. The lock and key combination as defined in claim 2, wherein said primary code surface is formed by an external groove forming said external portion (111; 141', 151) of said side recess, said external groove comprising two opposite side walls adjoining said one side surface of the flat key blade.

4. The lock and key combination as defined in claim 3, wherein said internal groove (112) is narrower than said external portion (111) of said side recess.

5. The lock and key combination as defined in claim 3, wherein said internal groove (152) is undercut and wider than said external portion (151) of said side recess.

6. The lock and key combination as defined in claim 5, wherein at least one of said second side locking tumblers (502) is provided with a finger (512*l*; 512*c*; 512*r*) having a first narrow portion and a second, widened portion being configured to fit into an undercut portion of said internal groove.

7. The lock and key combination as defined in claim 1, wherein at least one of said separate code surfaces (131-135; 141'-145) is wave-like.

8. The lock and key combination as defined in claim 1, wherein at least one of said first and second fingers (211*a*, 211*b*) is positively guided between opposite walls in said side recess (112, 111).

9. The lock and key combination as defined in claim 1, wherein one (211*b*) of said first and second fingers is higher than the other (211*a*), measured in a vertical dimension being transverse to a longitudinal direction of said key blade.

10. The lock and key combination as defined in claim 1, wherein at least one (401) of said first and second side locking tumblers is spring-biased so as to engage with the associated code surface.

11. The lock and key combination as defined in claim 1, wherein at least one (201*a*, 201*b*) of said first and second side locking tumblers is constituted by a half body being supplementary to another half body accommodated in the same chamber, the two half bodies in each pair being movable independently of each other.

12. The lock and key combination as defined in claim 11, wherein there is a longitudinal row of pairs (201*a*, 201*b*, 202*a*, 202*b*) of side tumblers, each pair comprising two supplementary half bodies.

13. The lock and key combination as defined in claim 1, wherein said first side tumblers (201*b*) and/or said second side locking tumblers (201*a*) are non-rotationally guided in said key plug.

14. The lock and key combination as defined in claim 13, wherein said side tumblers (302), which are non-rotationally guided in said key plug, are provided with transverse fingers which are located in a specific position which is centered (312*c*) in relation to or longitudinally displaced (312*l*, 312*r*) from a central plane extending through the respective side tumbler, transversely to the longitudinal direction of said key slot.

15. The lock and key combination as defined in claim 1, wherein at least one (401) of said side tumblers is rotationally guided in said key plug, and wherein the associated finger (411) is pivotable between two end positions, while being engaged by the associated code surface.

16. The lock and key combination as defined in claim 1, forming a part of a lock and key system having at least one master key (A) and at least two specific keys (B, C), all these keys (A, B, C) having a double code with primary and secondary code surfaces, said master key (A) being configured to release all locks in a group of locks having different kinds of locking tumblers (311*c* or 312*c*) at various positions, whereas each of said specific keys (B, C) is configured to release only one lock or a subset of locks within said group of locks.

17. A key (100) for operating a cylinder lock having a key plug with a key slot and at least two side locking tumblers, said key comprising: a substantially flat key blade (102) having, in a side recess, a code pattern (110) for engagement with transverse fingers projecting transversely from the side locking tumbler and positioning said side locking tumblers into positions that allow said key plug to rotate in said cylinder lock upon insertion of the key blade into the key slot, comprising:

said code pattern in the side recess of the key blade comprises at least two separate code surfaces being formed on at least one side of the key blade and extending along at least a part of the length of the key blade for engagement with the transverse fingers projecting transversely from the side locking tumbler and being rotatable, comprising, on the same side (101) of the key blade:

a primary code surface (131-135; 141'; 151) with first code surface portions specifically distributed longitudinally on at least one side wall in an external portion of said side recess and adjoining said one side surface of the key blade, and at least one secondary code surface (141-145; 142'; 152) with second code surface portions specifically distributed longitudinally in an internal, deeper portion of said side recess, said first and second code surface portions being located in well-defined positions which are generally variable or separated in three dimensions in a respective tumbler contacting region of said key blade, namely:

in a direction upwards and downwards in a vertical plane defining said flat key blade, in a depth direction which is perpendicular to said vertical plane, and in a longitudinal direction along said key blade, such that a compact code pattern with an increased number of code combinations is formed on the key blade.

18. A lock and key combination including a cylinder lock with a rotatable key plug having a key slot for receiving a flat key blade, and a key (100) with said flat key blade, and at least two side locking tumblers (201*a*, 201*b*; 301, 302; 401, 402) in said cylinder lock, said side locking tumblers being guided for at least one of elevational and rotational movement in associated chambers in said key plug and having transverse fingers (211*a*, 211*b*; 311, 312; 411, 412*a*, 412*b*) projecting into said key slot for engagement with said key blade, upon inserting said key into said key slot, and an associated code pattern (110) in a side recess (115, 118) of said key blade for engagement with said side locking tumblers and positioning said side locking tumblers into positions that allow said key plug to rotate in said cylinder lock upon inserting a correctly coded key into the key slot, wherein said associated code pattern in the side recess of the key blade comprises at least two separate code surfaces (111, 112; 141, 142; 151, 152) formed on at least one side of the key blade and extending along at least a part of the length of the key blade, wherein at least one of the two separate code surfaces is wave-like, comprising, on the same side surface (101) of the key blade:

a primary code surface (131-135; 141'; 151) located on at least one side wall or shelf surface in an external portion of said side recess and adjoining said one side surface, and at least one secondary code surface (141-145; 142'; 152) being defined in an internal groove forming a deeper portion of said side recess, and that said side locking tumblers of said cylinder lock comprise:

at least one first side locking tumbler (201*b*; 301; 401) having a transverse first finger (211*b*, 311, 411) configured to engage with said primary code surface on said side wall or shelf surface in said side recess, and at least one second side locking tumbler (201*a*; 302; 402*a*), located on the same side of the key slot as said first side locking tumbler and having a transverse second finger (211*a*, 312, 412*a*) extending into the internal deeper portion of said side recess and being configured to engage with said secondary code surface, wherein said primary code surface is formed by an external groove forming said external portion (111; 141', 151) of said side recess, said external groove comprising two opposite side walls adjoining said one side surface of the flat key blade and said internal groove (152) is undercut and wider than said external portion (151) of said side recess.

19. The lock and key combination as defined in claim 18, wherein said internal groove (112) is narrower than said external portion (111) of said side recess.

20. The lock and key combination as defined in claim 18, wherein at least one of said separate code surfaces (131-135; 141'-145) is wave-like.

21. The lock and key combination as defined in claim 20, wherein at least one of said second side locking tumblers (502) is provided with a finger (512*l*; 512*c*; 512*r*) having a first narrow portion and a second, widened portion being configured to fit into an undercut portion of said internal groove.

22. The lock and key combination as defined in claim 18, wherein at least one of said first and second fingers (211*a*, 211*b*) is positively guided between opposite walls in said side recess (112, 111).

23. The lock and key combination as defined in claim 18, wherein one (211*b*) of said first and second fingers is higher than the other (211*a*), measured in a vertical dimension being transverse to a longitudinal direction of said key blade.

24. The lock and key combination as defined in claim 18, wherein at least one (401) of said first and second side locking tumblers is spring-biased so as to engage with the associated code surface.

25. The lock and key combination as defined in claim 18, wherein at least one (201*a*, 201*b*) of said first and second side locking tumblers is constituted by a half body being supplementary to another half body accommodated in the same chamber, the two half bodies in each pair being movable independently of each other.

26. The lock and key combination as defined in claim 25, wherein there is a longitudinal row of pairs (201*a*, 201*b*, 202*a*, 202*b*) of side tumblers, each pair comprising two supplementary half bodies.

27. The lock and key combination as defined in claim 18, wherein said first side tumblers (201*b*) and/or said second side locking tumblers (201*a*) are non-rotationally guided in said key plug.

28. The lock and key combination as defined in claim 27, wherein said side tumblers (302), which are non-rotationally guided in said key plug, are provided with transverse fingers which are located in a specific position which is centered (312*c*) in relation to or longitudinally displaced (312*l*, 312*r*) from a central plane extending through the respective side tumbler, transversely to the longitudinal direction of said key slot.

29. The lock and key combination as defined in claim 18, wherein at least one (401) of said side tumblers is rotationally guided in said key plug, and wherein the associated finger (411) is pivotable between two end positions, while being engaged by the associated code surface.

30. The lock and key combination as defined in claim 18, forming a part of a lock and key system having at least one master key (A) and at least two specific keys (B, C), all these keys (A, B, C) having a double code with primary and secondary code surfaces, said master key (A) being configured to release all locks in a group of locks having different kinds of locking tumblers (311*c* or 312*c*) at various positions, whereas each of said specific keys (B, C) is configured to release only one lock or a subset of locks within said group of locks.

* * * * *